US006488067B1

(12) United States Patent
Fischer

(10) Patent No.: US 6,488,067 B1
(45) Date of Patent: Dec. 3, 2002

(54) TWO-PART DEVICE FOR PRODUCING A TOY WHEEL FROM CYLINDRICAL PLAYING BLOCKS COMPOSED OF A HARD FOAM

(75) Inventor: Artur Fischer, Waldachtal (DE)

(73) Assignee: Artur Fischer Tip GmbH & Co. KG, Waldachtal (DE)

( * ) Notice: Subject to any disclaimer, the term of this patent is extended or adjusted under 35 U.S.C. 154(b) by 183 days.

(21) Appl. No.: 09/629,955

(22) Filed: Aug. 1, 2000

(30) Foreign Application Priority Data

Aug. 4, 1999 (DE) ..... 299 13 238 U

(51) Int. Cl.[7] ..... B32B 31/00

(52) U.S. Cl. ..... 156/512; 156/258; 156/266; 156/304.1; 156/512; 156/558; 269/289 R; 269/329; 269/902; 29/894; 446/86; 446/87

(58) Field of Search ..... 156/258, 266, 156/304.1, 512, 558; 269/289 R, 329, 902; 29/894; 446/86, 87

(56) References Cited

U.S. PATENT DOCUMENTS

| | | | | | |
|---|---|---|---|---|---|
| 4,158,523 | A | * | 6/1979 | Schotzko | 405/115 R |
| 4,210,476 | A | * | 7/1980 | McKay | 156/112 |
| 4,341,376 | A | * | 7/1982 | Germinario | 269/288 |
| 6,203,649 | B1 | * | 3/2001 | Kremsmair et al. | 156/211 |

FOREIGN PATENT DOCUMENTS

DE 197 49 493 A1 3/1999

* cited by examiner

*Primary Examiner*—Linda Gray
(74) *Attorney, Agent, or Firm*—Michael J. Striker

(57) ABSTRACT

A two-part device for producing a toy wheel from cylindrical playing blocks composed of a hard foam, the device has a cutting device having a trough for insertion of a playing block and a guide for a separating tool extending at an angle to the trough, a joining device which has a circular-ring-shaped trough for insertion of playing block segments cut with the cutting device from the playing blocks, and a wheel shaft hole which is coaxial to the trough of the joining device for passing a wheel shaft.

6 Claims, 2 Drawing Sheets

TWO-PART DEVICE FOR PRODUCING A TOY WHEEL FROM CYLINDRICAL PLAYING BLOCKS COMPOSED OF A HARD FOAM

BACKGROUND OF THE INVENTION

The present invention relates to a two-part device for producing a toy wheel of cylindrical playing blocks which are composed of hard foam.

Such playing blocks are disclosed for example in the German patent document DE 197 49 493. The known playing blocks are molded and foamed from an agricultural raw material by injection molding. The playing blocks have an approximately cylindrical shape with spherical end surfaces. They are self-adhesive by moistening and thereby can be connected with other playing blocks.

SUMMARY OF THE INVENTION

Accordingly it is an object of present invention to provide a device with which a toy wheel can be produced from playing blocks of the above mentioned type.

The device in accordance with the present invention has a cutting device with a trough, in which a playing block can be inserted. In an angle inclined to the trough, the cutting device has a guide for a separating tool, for example a knife or a saw, so that a playing block inserted in the cutting device can be exactly cut through at a predetermined angle to its imaginary longitudinal axis. With double cutting of the playing block at axially spaced points, a playing block segment can be produced, whose end surfaces are arranged at an angle relative to one another. From a plurality of such playing block segments, a circular ring can be produced, whereby the end surfaces of the playing block segments are located in radial planes of the circular ring.

The inventive device has a joining device with a circular-ring-shaped trough for insertion of a number of the playing block segments, which are produced in the above described manner in the cutting device. By insertion in the circular ring-shaped trough of the joining device, the playing block segments abut against one another to form the above mentioned circular ring and are connected with one another, for example by glueing.

It is advantageous when the playing blocks are adhesively connected by moistening, so that no additional adhesive as an additional material is needed. The joining device can have a wheel shaft hole which is coaxial to its circular ring-shaped trough. In the wheel shaft hole, a wheel shaft for example a round wood rod, a straw stalk or the like can be introduced, and is held coaxially to the circular ring formed in the trough of the joining device from inserted playing block segments. A circular cover disk composed for example of paper board and provided with a central opening can be fitted on the wheel shaft. The circular ring formed of the playing block segments can be arranged on it, and they are glued together. The wheel shaft plugged in the wheel shaft hole orients the cover disk concentrically to the circular ring assembled from the playing block segments.

Finally, the circular ring which is assembled from the playing block segments and provided at one side with a cover disk can be withdrawn from the joining device, placed on its wheel side, and after piercing of the wheel shaft, provided with a cover disk on its second side. The wheel disk orients the second cover disk with respect to the first cover disk already applied on the circular ring, coaxially to the circular ring. The toy wheel is finished.

The present invention has the advantage that in a simple and child-friendly manner the manufacture of substantially circular toy wheel is possible. The toy wheel has wheel shaft openings for passage of a wheel shaft at both sides of the toy wheel, which is concentrical to the toy wheel. The toy wheel produced in accordance with the present invention rolls well, it is stable and has a diameter which is many times greater than the diameter of the used, cylindrical playing boxes. Furthermore, the present invention has the advantage that it makes producing possible at any number of identical toy wheels.

Preferably, the cutting device has two guides, which are arranged at a distance from one another and at an angle to the trough of the cutting device. During cutting of a playing block inserted in the cutting device with the aide of the two guides, a plane block segment is produced which can be assembled with further, identical playing block segments to form the circular ring. The distance between the two guides of the cutting device from one another and there angle towards the trough of the cutting device are selected so that the separating or end surfaces of the playing block segments are located in radial planes of the circular ring assembled from the playing block segments in the inventive joining device.

In accordance with another embodiment of the present invention, the guide of the cutting device is a slot, in which for example a saw, a knife or separating tool can be guided. This type of guidance is simple and allows the use of available knives or separating tools so that no special separating tool is needed.

It is advantageous when the slot is deeper than the trough of the cutting device. Thereby the playing block inserted in the trough of the cutting device can be completely cut through.

In accordance with a further embodiment of the present invention, the cutting device has an abutment surface for the separating tool, for leading, the separating tool before the separating tool reaches the slot which serves as a guide of the cutting device. The abutment surface is located in one plane with a slot side wall, an abutment surface increases the slot at one side.

In accordance with a further embodiment of the present invention, the device has a knife with a blade, a saw with a blade or a separating tool. The separating tool has a lateral thickening which extends substantially parallel to and at a distance from a blade of the separating tool. In a saw, the blade has an imaginary line over the saw teeth. The lateral thickening can be formed for example as a bead. The lateral thickening can be formed also for example by a blade, plate or the like of a separating tool with a wedge-shaped cross-section.

The lateral thickening can be one-sided or two-sided. When the separating tool is introduced into the slot of the cutting device, the lateral thickening limits a penetration depth of the separating tool of the slots. The lateral thickening prevents sitting of the blade of the separating tool on the bottom of the slot and therefore prevents a dulling of the separating tool. In addition, the penetration of the separating tool in the slot is dimensioned so that, a playing block inserted into trough of the cutting device is completely cut through.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
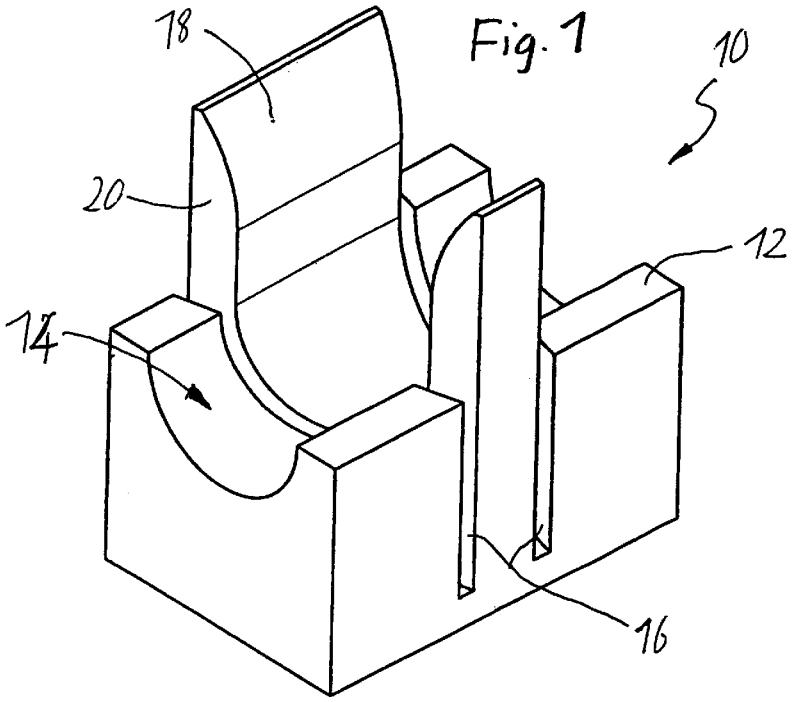
FIG. 1 is a cutting device of a device for producing a toy wheel in accordance with the present invention in a perspective showing.

A device shown in the drawings is used for producing a toy wheel from cylindrical playing blocks which are composed of a hard foam. The inventive device has a cutting device 10 which is shown in FIG. 1. The cutting device 10 is composed of a synthetic plastic, it has a basic form of a parallelepiped with a length which is greater than width and height. A semi-circular trough 14 is formed in a side of the cutting device 10 which is identified as an upper side 12. A not shown substantially cylindrical playing block composed of a hard foam is insertable in the trough 14.

The trough 14 has a substantially smaller diameter than the playing block, or an undersize with respect to the playing block so that the playing block inserted in the trough 14 of the cutting device 10 has a firm hold. Two slots 16 are provided in the cutting device 10 and form guides for a separating tool, for example a knife shown in FIG. 2. The both slots 16 are inclined, so that they limit therebetween a central region 18 which is ring-shaped on the plan view of the upper side 12 of the cutting device. The both slots 16 are arranged at a same angle and in opposite directions inclinedly to an imaginary longitudinal axis of the trough 14 of the cutting device 10. The both slots 16 are deeper than the trough 14 to provide a complete separation of an inserted playing block.

The central region 18 of the cutting device 10 extends upwardly beyond the upper side 12 of the cutting device 10. Side surfaces of the central region 18 form abutment surfaces 20 which facilitate placement of the separating tool. The abutment surfaces 20 are located in one plane with a slot side wall, which limits the central region 18. The abutment surfaces 20 on the corresponding slot side walls form a common plane. In addition, the central region 18 holds the inserted playing block clampingly in the cutting device 10.

Figure 2:
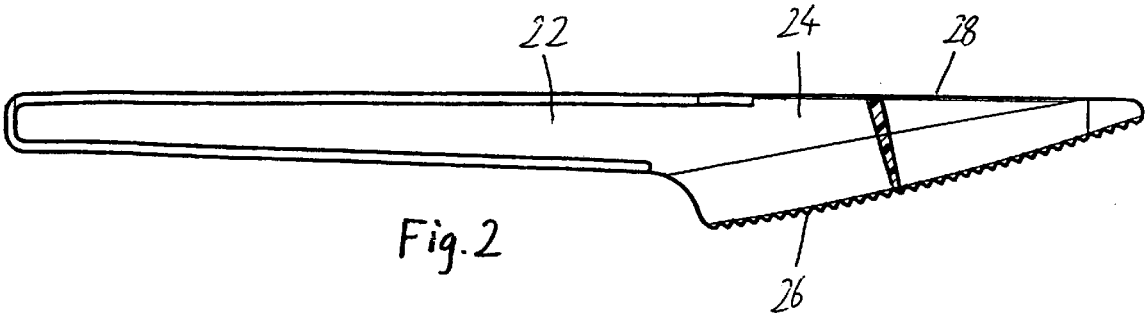
FIG. 2 is a view showing a separating tool which is formed as a cutter of the cutting device, of the inventive device for producing a toy wheel.

The separating tool is formed for example as a knife 22 shown in FIG. 2. As a well known disposable article, it is composed of a synthetic plastic. The knife 22 is however provided only for limited repeated use. The knife 22 has a blade 24 with teeth 26, which form a cutting edge 26 of the knife 22. The blade 24 of the knife 22 is wedge-shaped as shown in FIG. 2. The blade 24 extends from the cutting edge 26 to the edge back 28. This expansion of the edge 26 in direction to the edge back 28 forms a lateral thickening of the knife 22, to limit a penetration depth of the blade 24 into the slot 16 of the cutting device 10 which forms the guide. The blade 26 goes deeper than the trough 14, but the blade 24 can not sit on the base of the slot 16. Thereby a dulling of the blade 24 of the knife composed of synthetic plastic is prevented.

The teeth 26 of the knife 22 are inclined at one side in a transverse direction of the knife 22 so that one of the side surfaces of the edge 24 passes flatly to the tip of the teeth 26. Thereby at this side the playing block inserted in the cutting device 10 can be cut with a blade 24 in one plane with the abutment surface 20 and the adjoining slot side wall which provides a high accuracy of the cutting of the playing block.

Figure 3:
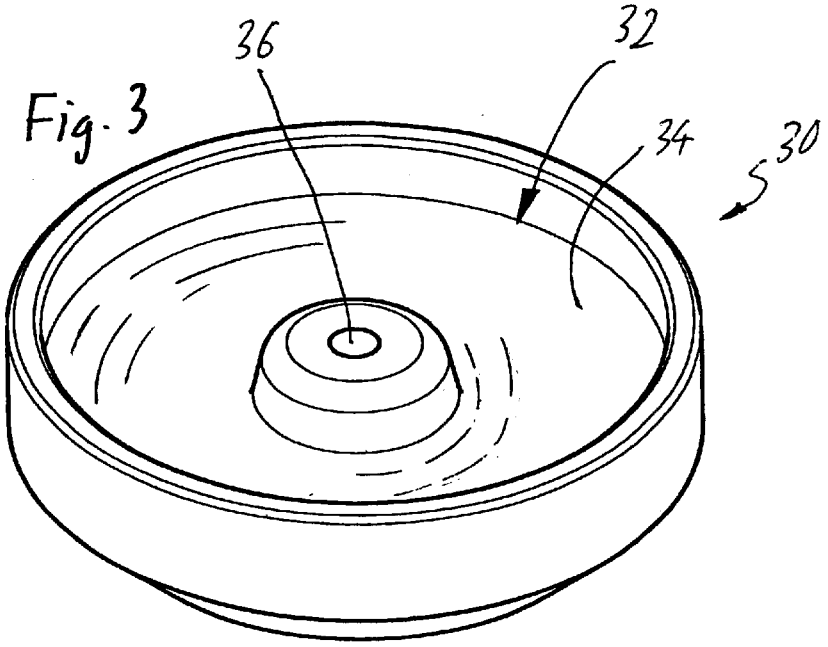
FIG. 3 is a joining device of the inventive device for producing a toy wheel, in a perspective view.
Figure 4:
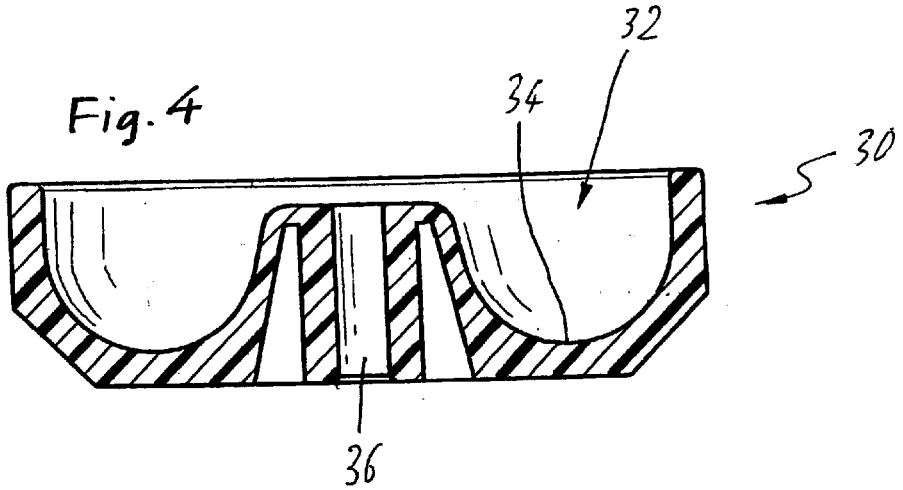
FIG. 4 is a view showing the portion of the joining device of FIG. 3 of the inventive device for producing a toy wheel.

The inventive device has a joining device 30 shown in FIGS. 3 and 4. The joining device 30 has the shape of a circular disk. It has a circular-ring-shaped trough 32 with a base having a semi-circular cross-section. A diameter of the base 34 corresponds to the diameter of the inserted, not shown cylindrical playing block composed of a hard foam. Coaxially to the circular-ring-shaped trough 32, the joining device 30 is provided with a gear wheel hole 36.

The operation of the inventive device is as follows:

In order to produce a toy wheel, a not shown, cylindrical playing block composed of a hard foam and made adhesive by moisturizing is inserted in the cutting device 10. The playing block is cut with the knife 22 as a cutting tool in the slots 16, so that in the central region 18 a playing block segment is produced with separating and end surfaces located at an angle relative to one another. This cutting step is repeated with several playing blocks so often, until a sufficient number of the playing block segments, (in the shown example 10 pieces) is produced.

Figure 5:
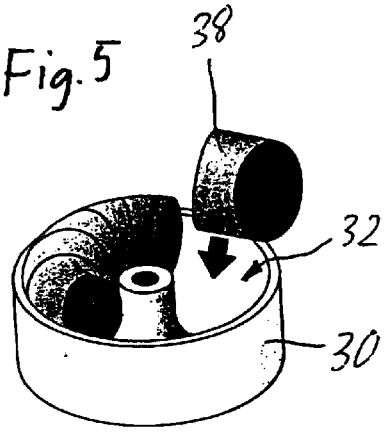
FIGS. 5 and 6 are views showing the use of the inventive joining device.
Figure 6:
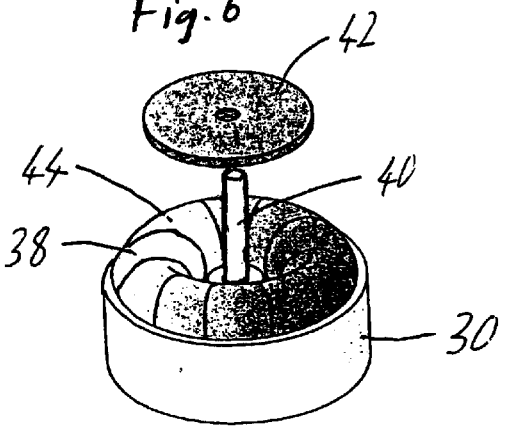

The playing block segments produced by the cutting of the playing block in the cutting device 10 are moisturized on their end and separating surfaces and as shown in FIG. 5, inserted in the circular-cylinder-shaped ring 32 of the joining device 30. The playing block segments identified in FIG. 5 with reference numeral 38 are arranged by insertion into the trough 32 of the joining device 30 in a circular ring and glued with one another by moistening of the adhesive moisturize end surfaces to form a circular ring. The angle between the both slots 16 of the cutting device 10 relative to one another and the distance between the slots 16 from one another are selected so that, a predetermined number of the playing block segments 28 (in the shown example 10 such playing block segments) form a circular ring.

After the glueing of the playing block segments 38 to form a circular ring, the wheel shaft 40 for example a straw stalk or a wood rod, is plugged into the wheel shaft hole 36 of the joining device 30, and the circular ring assembled from the playing block segment 38 is moisturized on its upper side. Subsequently, a circular-round paper board disk is fitted with a central hole on the wheel shaft 40 as a cover disk 42 and pressed on the circular ring 44 so as to be glued in this way with the circular ring 44.

For glueing a second cover disk the circular ring 44 is removed from the joining device 30 and in a not shown manner placed on a lower side of the joining device 30. The wheel shaft 40 is inserted through the wheel shaft hole 36 and a central hole of the cover disk 42, and a second, not shown cover disk is glued on the other side of the circular ring 44. Therefore the wheel shaft 40 centers the second cover disk on the circular ring 44. The wheel ring 44 assembled from the playing block segment 38 together with the cover disks 42 glued at both sides, forms a toy wheel.

It will be understood that each of the elements described above, or two or more together, may also find a useful application in other types of constructions differing from the types described above.

While the invention has been illustrated and described as embodied in two-part device for producing a toy wheel from cylindrical playing blocks composed of a hard foam, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A two-part device for producing a toy wheel from cylindrical playing blocks composed of a hard foam, the device comprising a cutting device having a trough for insertion of a playing block and a guide for a separating tool extending at an angle to said trough; a joining device which has a circular-ring-shaped trough for insertion of playing block segments cut with said cutting device from the playing blocks, and a wheel shaft hole which is coaxial to said trough of said joining device for passing a wheel shaft.

2. A two-part device as defined in claim 1, wherein said cutting device has two guides which are spaced from one another at a distance and are located at opposite angles relative to said trough of said cutting device.

3. A two-part device as defined in claim 1, wherein said guide of said cutting device for a separating tool is a slot.

4. A two-part device as defined in claim 3, wherein said slot is deeper than said trough of said cutting device.

5. A two-part device as defined in claim 3, wherein said cutting device has a projecting abutment surface for a separating tool, located in one plane with a slot side wall.

6. A two-part device as defined in claim 4; and further comprising a separating tool having a lateral thickening which extends substantially parallel to and at a distance from a blade of said separating tool and limits a penetration depth of a separating tool into said slot of said cutting device so that said blade can reach a base of said trough of said cutting device but can not reach a base of said slot.

* * * * *